US006142711A

United States Patent [19]

Goughnour

[11] Patent Number: 6,142,711

[45] Date of Patent: Nov. 7, 2000

[54] VIBRATOR HAVING A ROTATING AND OSCILLATING HOUSING

[76] Inventor: R. Robert Goughnour, 705 Duff Rd. NE., Leesburg, Va. 20176

[21] Appl. No.: 09/285,665

[22] Filed: Apr. 5, 1999

[51] Int. Cl.[7] ..... E02D 7/18

[52] U.S. Cl. ..... 405/232; 405/182; 74/61

[58] Field of Search ..... 405/182, 232; 172/40; 74/61, 109; 173/49; 248/638

[56] References Cited

U.S. PATENT DOCUMENTS

| | | | |
|---|---|---|---|
| 2,227,867 | 1/1941 | Steinhaus | 74/61 |
| 2,675,985 | 4/1954 | Boiteux | 248/638 |
| 3,891,186 | 6/1975 | Thorsell | 254/29 |
| 4,755,080 | 7/1988 | Cortlever et al. | 405/50 |
| 5,088,565 | 2/1992 | Evans | 173/49 |
| 5,213,449 | 5/1993 | Morris | 405/232 |
| 5,439,326 | 8/1995 | Goughnour et al. | 405/303 |
| 5,658,091 | 8/1997 | Goughnour et al. | 405/50 |

FOREIGN PATENT DOCUMENTS 7707303 7/1977 Netherlands .

*Primary Examiner*—Eileen D. Lillis
*Assistant Examiner*—Sunil Singh
*Attorney, Agent, or Firm*—Carothers & Carothers

[57] ABSTRACT

A vibrator for vibrating an object. The vibrator is provided with a rotary housing mounted on a frame for rotation about an axis. Multiple rotary eccentric masses are mounted at equally spaced intervals in this housing about the housing axis and they are mounted for rotation on their respective axes which are parallel to the housing axis. A rotary drive is connected for simultaneously rotating the eccentric masses in the same direction and in synchronism such that all masses are directed simultaneously to their inner most and their outer most positions of movement relative to the housing axis. This generates a force moment about the housing axis which rotatably oscillates the housing.

14 Claims, 5 Drawing Sheets

VIBRATOR HAVING A ROTATING AND OSCILLATING HOUSING

BACKGROUND OF THE INVENTION

This invention relates generally to vibrators and more particularly to vibrators for assisting in the insertion of flexible members, such as tie-back anchors for slope stabilization or prefabricated vertical (PV) drains (sometimes referred to as wick or band drains) into dense or hard soil layers or vibrators for soil or sand compaction.

One well known technique for improving soft, saturated soil, such as wet clay, for example, is to drive into the soil a drainage element (PV drain) that penetrates deep into the soil with the top end of the drainage element maintained above the surface of the soil. The PV drain is formed of any suitable material which is water permeable, or perforated to be water permeable, so that the water in the soil can penetrate the walls of the drain and flow upwardly therein, to the surface of the soil as a result of water pressures in the soil beneath the surface. It is common practice in such situations to increase these inherent water pressures in the soil by placing a layer of earth on top of the wet soil so that the weight thereof will assist in forcing the water into and upwardly through the PV drains, where it can be readily disbursed.

The PV drain is generally elongated and flexible and it is carried into the ground by utilizing a rigid insertion tube or mandrel formed of suitable metal. This insertion tube, together with the drain contained therein, is driven downwardly into the earth to the desired depth and then the insertion tube is pulled out of the soil thereby leaving the PV drain. The drains are inserted at regular predetermined intervals in the earth, depending upon soil conditions and moisture content.

This rigid insertion tube or mandrel, which carries the elongated, flexible PV drain therein, is adapted for vertical movement within a mast. The insertion tube is forcibly driven into the earth, and then pulled out by any one of different known drive systems. For example, in Dutch Patent No. 7,707,303, there is disclosed a drive arrangement which uses a vibratory driver that engages the top portion of the insertion tube for driving the bottom end of the insertion tube into the earth. In Cortlever, U.S. Pat. No. 4,755,080, a combination of hydraulic cylinders and a cable drive that engages the insertion tube at the upper end thereof is utilized, and a somewhat similar hydraulic motor and chain drive is disclosed in Thorsell U.S. Pat. No. 3,891,186.

In general, most of these prior art arrangements engage and drive the insertion tube at its top end, requiring a relatively heavy mast and boom arrangement to support the insertion tube or mandrel and the drive mechanism. This not only increases the weight of the apparatus, but also increases the cost of fabrication as well as maintenance.

It is also known to utilize vibratory means in combination with cable or chain drives. These rigs are commonly referred to as vibro/static machines. In these machines a vibrator is mounted to the top of the mandrel to impart vertical vibration to the mandrel. Elastomers placed between the mandrel and the drive (chain, cables etc.) isolate the vibrations from the drive and mast. From a geotechnical standpoint, it is preferable to install wick drains without the use of vibration, since such vibration can remold the soil in close proximity with the mandrel, resulting in loss of strength and decreased permeability. Lower permeability of the soil in this region impedes the flow of water into the drain, requiring longer surcharge periods. However, vibration greatly enhances the ability of the apparatus to penetrate the ground, and it is often necessary to penetrate through dense or hard soil layers to reach an underlying soft soil layer. These layers are often so hard that it is not possible to penetrate them without the use of a vibratory system. The combination machines (vibro/static) are very useful in these cases, since the vibration can be turned on only during penetration through the hard layers. Further, vibrating the mandrel induces very high vibratory stresses, and fatigue of the mandrel material becomes a problem.

It is also known that the insertion tube can be driven into the earth utilizing a pair of friction rollers positioned just above the surface of the earth, these rollers being formed of a material that will frictionally engage the side walls of the insertion tube disposed therebetween with the frictional engagement between the rollers and the insertion tube, thus driving the insertion tube into the ground. This prior art friction roller arrangement overcomes the problem of engaging the insertion tube at its upper end, but suffers from a tendency of the friction rollers to slip when the mandrel or insertion tube is covered with wet, slippery soil material which adheres to the mandrel. The Morris Patent (U.S. Pat. No. 5,213,449) overcomes this problem by utilizing a drive gear to positively engage a flange or fin which is attached to and coextends with the mandrel. This flange contains rack gear mesh openings spaced along its length, which the teeth of the drive gear engage. This arrangement is similar to a rack and pinion arrangement.

Goughnour and Joiner (U.S. Pat. No. 5,658,091)disclose a vibro/static system whereby a vibratory driver is positioned at and attached to the upper end of the mandrel for imparting vibrations to assist in its penetration. A drive which includes a rotary drive gear, that engages a mandrel/fin, and a motor for driving the gear is mounted at the bottom of the mast as with the Morris Patent. A flexible torsion coupler between the motor and the drive gear isolates the motor and the mast from vibrations imparted to the mandrel by the vibrator.

These same techniques are also utilized for inserting other members into the earth, such as tie-back anchors for slope stabilization.

The vibrator of the present invention permits mounting of the vibrator at a lower level on the mast of the apparatus of the type disclosed in the Morris Patent or the Goughnour/Joiner Patent. The present invention also permits the apparatus of the type disclosed in the Morris Patent to operate without vibration to the supporting equipment and the vibrating shock imparted to the mandrel is isolated from the motor and planetary gear box and the remainder of the machine. This permits application of vibrations to the mandrel either intermittently or constantly as required and greatly extends the usefulness and life of the machine.

The vibrator of the present invention has numerous applications wherein it is desired to have vibratory rotation about an axis. It may not only be utilized for driving flexible members such as PV drains and tie-backs, but in addition it may also be directly attached to Caisson or pipe or probes for imparting rotary vibration thereto.

SUMMARY OF THE INVENTION

The vibrator apparatus of the present invention may be used for assisting in insertion of flexible members downwardly into the earth, such as flexible tie backs or flexible drain members. The insertion apparatus includes an articulatable mast to be arranged above the underlying earth and an elongated earth penetrating mandrel carried by the mast for guided movement along the mast. The mandrel receives a flexible member for movement with the mandrel to insert flexible members in the underlying earth.

In typical fashion, a drive is mounted on the mast and engaged with the mandrel for driving the mandrel into and out of the underlying earth and a vibrator is mounted to impart vibrations to the mandrel along its line of travel to assist movement of the mandrel in the underlying earth when the vibrator is energized.

The vibrator of the present invention is provided with a rotary housing for rotation about an axis perpendicular to the mast or to the desired line of vibration. At least two rotary eccentric masses are mounted at equally spaced intervals in the housing about the housing axis and mounted for rotation on respective axes which are parallel to the housing axis.

A rotary drive is connected for simultaneously rotating these eccentric masses in the same direction and in synchronism such that all masses are directed simultaneously to their inner most and their outer most positions of movement relative to the housing axis whereby a force moment is generated about the housing axis which rotatably oscillates the housing. A gear is thereby rotatably coupled to and driven by this housing for alternating rotation with the housing to provide the required vibrations to be imparted to the mandrel.

The circular gear utilized for imparting vibrations to the mandrel is free wheeling except for engagement with a gear rack on the mandrel and it may also be simultaneously employed by the mandrel drive, sometimes referred to as the static drive, whereby the drive is connected directly to this vibrator gear for driving the mandrel into and out of the underlying earth with the gear, as well as utilizing the gear for imparting vibrations to the mandrel.

A ballast mass is preferably attached to the vibrator for minimizing vibratory amplitude of the vibrator and thereby increasing vibrating forces and mass momentum applied to the mandrel.

In most installations of the present invention, it is also desirable to utilize a flexible drive coupling between the motor and the drive member driven by the motor that drives the mandrel into and out of the underlying earth for isolating the motor from vibrations generated by the vibrator. This coupling may take on the form of a flexible torsion coupler as shown in U.S. Pat. No. 5,658,091, or it may take on the form of other flexible drives such as a chain drive.

The vibrator is preferably mounted to the mast but may also be mounted to the static drive. It is also desirable that the vibrator be mounted on elastomer mounts for isolating the mast or drive member from vibrations generated by the vibrator and applied to the mandrel.

It must be recognized that the vibrator of the present invention may be utilized in any field of application where vibratory rotation about an axis is required. In this regard, the vibrator of the present invention is therefore not necessarily used or needed to be used in conjunction with the afore described circular gear and gear rack combination. The vibrator of the present invention may be directly applied to the object to be vibrated without the use of this rack and pinion coupling. For example, the vibrator may be mounted directly on top of caisson or pipe for insertion into the earth or on top of a probe imbedded into the earth for soil compaction.

BRIEF DESCRIPTION OF THE DRAWINGS

Other objects and advantages appear hereinafter in the following description and claims. The accompanying drawings show, for the purpose of exemplification, without limiting the invention or the appended claims, certain practical embodiments illustrating the principals of this invention wherein:

DESCRIPTION OF THE PREFERRED EMBODIMENTS

Figure 1:
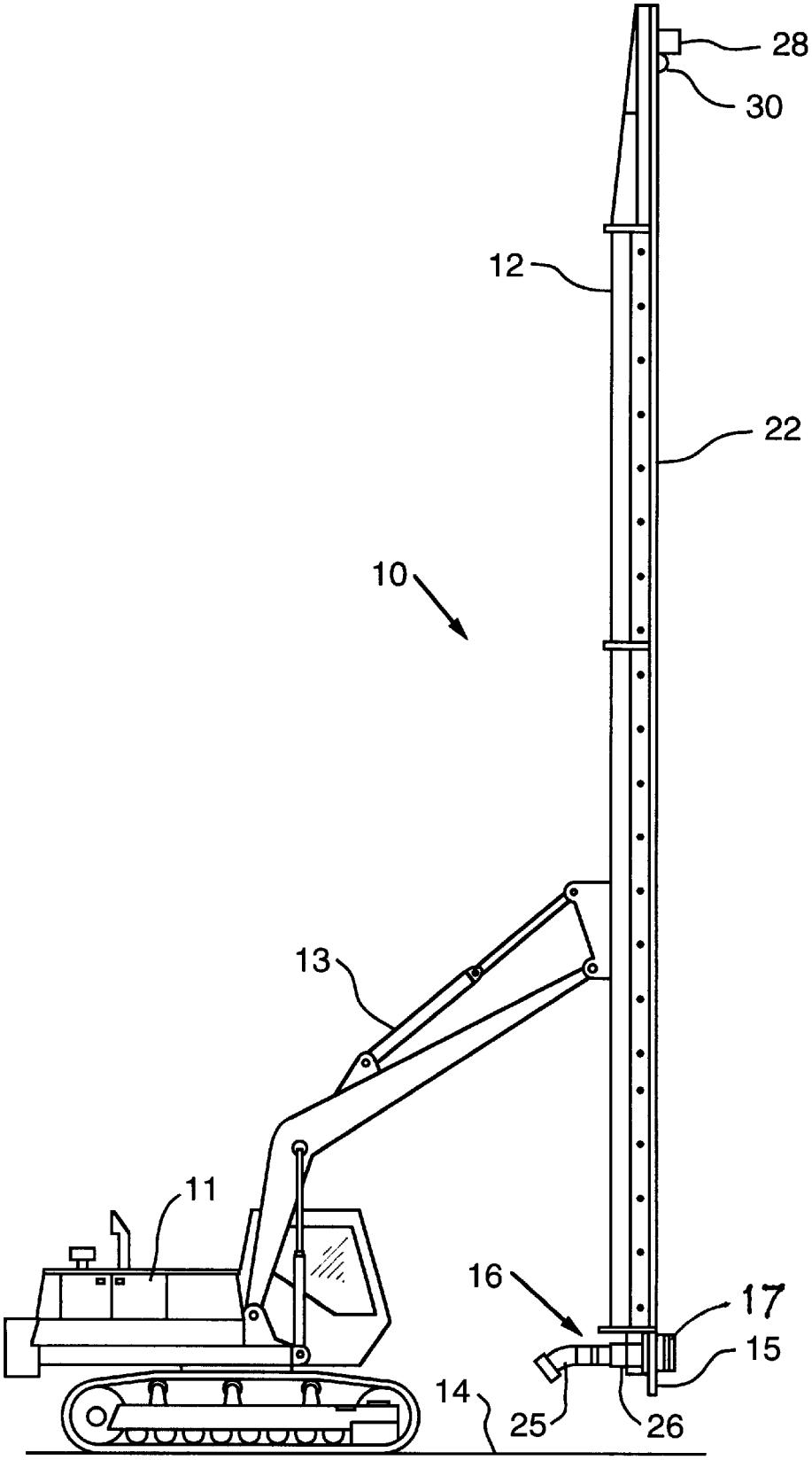
FIG. 1 Prior Art
FIG. 1 is a general overall view in vertical side elevation illustrating prior art apparatus for insertion of prefabricated vertical drains wherein the vibrator is mounted at the top of the mandrel.
Figure 1A:
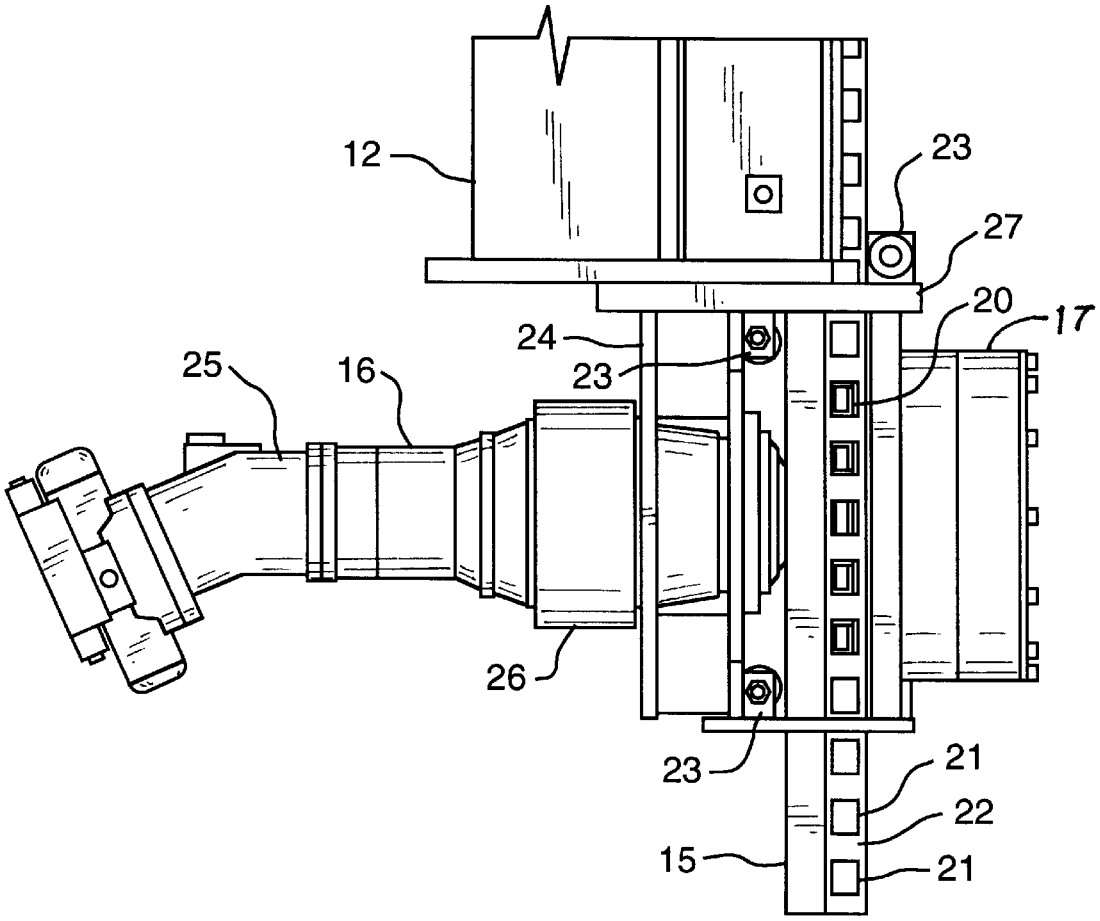
FIG. 1A Prior Art
FIG. 1A is an enlarged view of the drive structure shown at the bottom of the prior art apparatus of FIG. 1.

Referring to FIGS. 1 and 1A, the drain inserting apparatus 10 of the prior art is supported by a motorized vehicle or tractor 11, which may be of any suitable conventional type, and supports and manipulates the mast 12 with hydraulically operated manipulating arms 13. The mast 12 may be manipulated by arm 13 such that it extends generally upright above or perpendicular to the underlying earth 14 as shown in FIG. 1.

An elongated earth penetrating mandrel 15 is carried within hollow tubular mast 12 for vertical movement relative to mast 12. Mandrel 15 is a hollow insertion tube which is adapted to receive a drain member therein for movement with the mandrel in order to insert the drain members or other flexible members into the underlying soil 14 in exactly the same manner as is described in Morris U.S. Pat. No. 5,213,449.

In similar fashion to the drive mechanism disclosed in Morris, the drive mechanism 16 is mounted on mast 12, adjacent the lower end thereof, for driving mandrel 15 into and out of underlying earth 14. This drive includes a rotary drive gear 20 which engages the aligned rack gear openings 21 of mandrel fin or flange 22 in rack and pion fashion to vertically drive mandrel 15 as described in detail in the Morris Patent. The support rollers 23 are rotatably carried on the drive housing 24 to hold the flange 22 against drive gear 20.

The drive 16 includes a suitable hydraulic reversible drive motor 25 and a speed reduction planetary gear box 26 of the type described in the Morris Patent and a flexible coupling 17, which is not specifically illustrated since it is prior art shown in U.S. Pat. No. 5,658,091. The motor and gear box are mounted to the rear portion of the drive 16 as viewed in FIG. 1 and as shown in detail in FIG. 1A, and is supported and mounted directly to mast 12 by mount 27. Gear box housing 26 and drive 16 in general are also supported on the lower end of mast 12.

Vibrator 28 is mounted on flange or fin 22 of mandrel 15 adjacent the upper end of mandrel 15. Vibrator 28 is a design of the present invention for imparting vertical vibrations to mandrel 15. Vibrator 28 is rigidly secured to shelf 30 which in turn is directly attached as by welding to mandrel 15 via the extending flange 22, which is exposed through a side channel opening of tubular mast 12.

The drive box 16 at the lower end of mast 12 is modified to isolate vibration of the mandrel 15 from the mast 12 and the carrier vehicle 11. The vibration damping component is comprised of a flexible torsion drive coupler which couples drive gear box 26 to drive gear 20 to in turn vertically drive mandrel 15 and yet isolate motor 25 and gear box 26, and for that matter other associated parts of the apparatus 10, from vibration imparted to mandrel 15 by vibrator 28.

Figure 3:
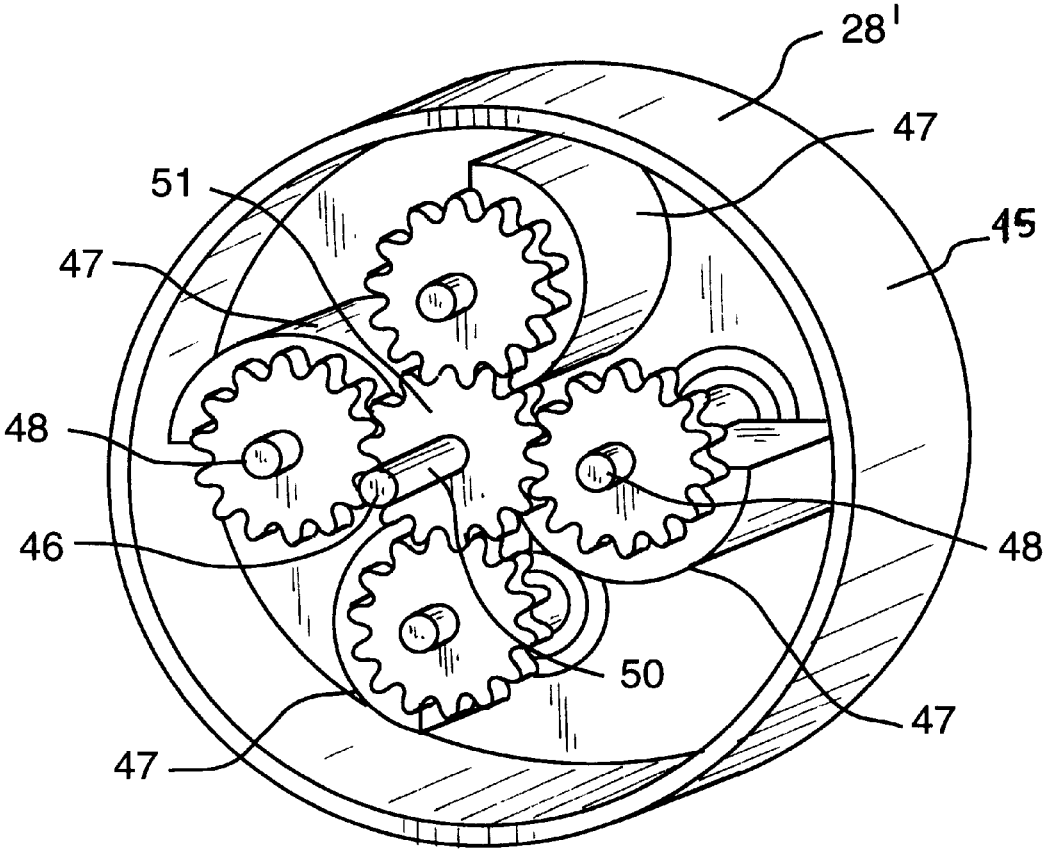
FIG. 3 illustrates the housing of the vibrator shown in FIG. 2 alone with its cover removed to reveal the internal working.

The flexible torsion drive coupler is not specifically illustrated since it is fully illustrated in the prior art as seen specifically as drive coupler 34 illustrated in FIG. 3 of U.S. Pat. No. 5,658,091. These torsion couplers are commercially available per se on the market and are manufactured by Lord Industrial Products.

Figure 2:
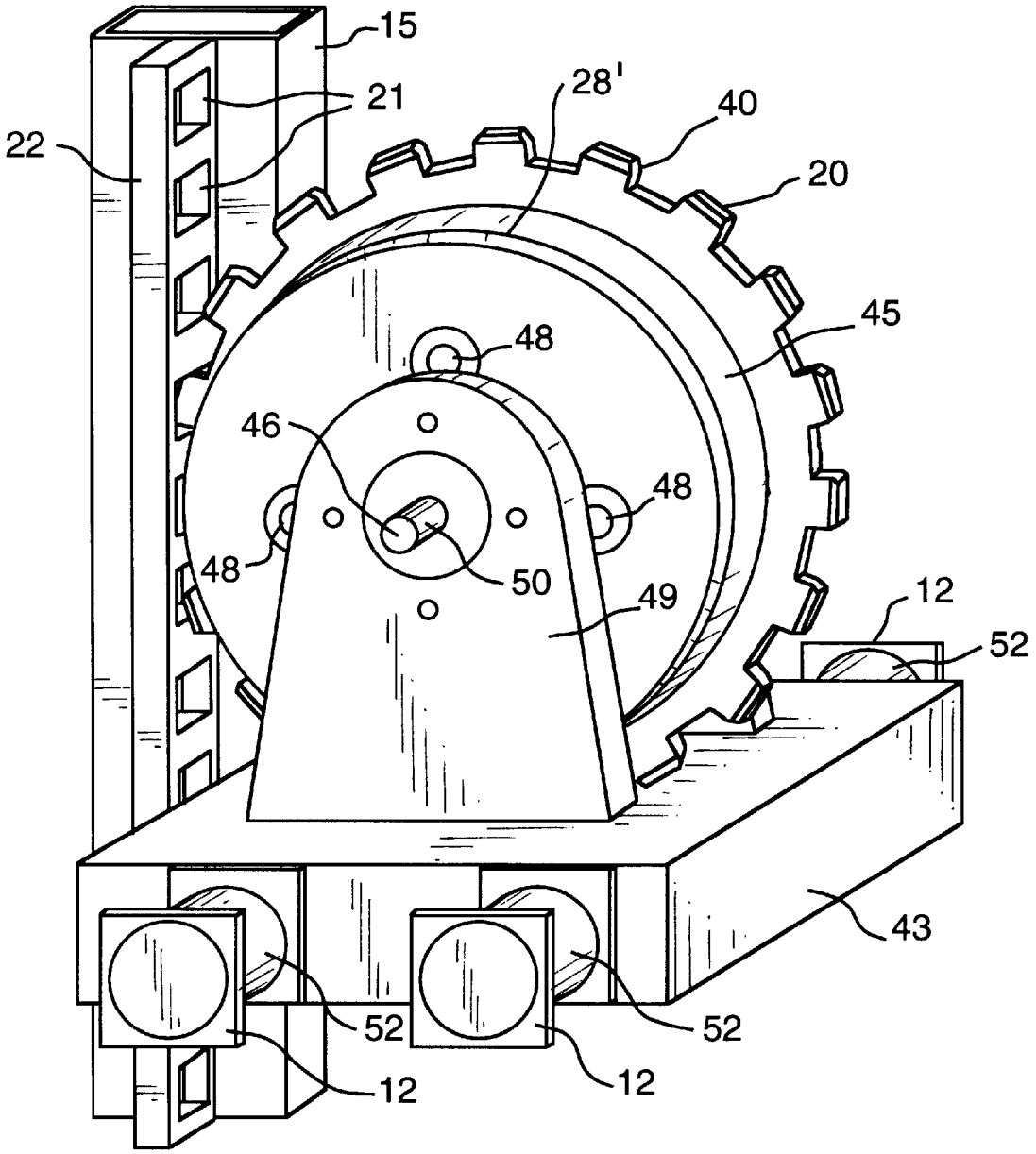
FIG. 2 is an isometric view illustrating the details of the vibrator of the present invention which is utilized for insertion of prefabricated vertical drains and wherein the vibrator is illustrated as being mounted at the bottom of the mast structure of the apparatus shown.

Referring next to FIGS. 2 and 3, detail of the vibrator 28' of the present invention is illustrated.

In the apparatus of FIGS. 1 and 1A, the vibrator 28 is positioned at the top of the mast 12. The structure of FIGS. 2 and 3 illustrates the basic apparatus of FIG. 1 with the vibrator 28' of the present invention mounted instead at the bottom of the mast 12 adjacent the static drive 16. The structural requirements on the mast are accordingly much reduced.

Vibrator 28' is provided with a rotary housing 45. Rotary housing 45 is mounted for rotation about an axis 46 which is perpendicular to the mandrel 15 and mast 12.

Housing 45 is coaxially coupled to circular gear 40 that in turn is meshed with gear rack flange 22 on mandrel 15. In this illustration, a single gear and rack mechanism 40, 22 is utilized as opposed to a dual drive mechanism. However, a dual ganged vibrator drive gear and rack 40,22 may be preferred to provide a balanced drive.

Four rotary eccentric masses 47 are mounted at equally spaced intervals in housing 45 about housing axis 46 and these eccentric masses 47 are mounted for rotation on respective axes 48 which are parallel to housing axis 46.

A rotary drive, including a motor (not shown for clarity), to be mounted to bracket 49, and including drive shaft 50 and central drive gear 51, is connected for simultaneously rotating the eccentric masses 47 in the same direction (all clockwise or all counterclockwise as seen in FIG. 3) in synchronism such that all masses 47 are directed simultaneously to their inner most and their outer most positions of movement relative to housing axis 46 whereby a force moment is generated about the housing axis 46 which rotatably oscillates the housing. Gear 40 is rotatably coupled to and driven by the housing 45 for alternating rotation vibrations therewith. This in turn applies the appropriate vibrations, when energized, to gear rack flange 22 and mandrel 15.

A ballast mass 43 is attached to vibrator 28' for minimizing amplitude of the vibrator and thereby increasing vibratory forces or mass momentum applied to the mandrel 15.

Ballast mass 43 is in turn supported to and connected by mast 12 through elastomers 52 in order to isolate the vibrations from mast 12.

It is preferable that the vibrator 28' and ballast mass 43 be connected to elastomers 52 directly to a lower portion or even the bottom end of mast 12 as part of or adjacent to static drive.

Vibrator gear 40 may in and of itself also be utilized as the drive gear 20 for driving the mandrel 15 into and out of the underlying earth while being simultaneously also utilized for imparting the required vibrations to the mandrel 15 when the vibrator 28' is energized.

In either situation, the static drive 16 is provided with a flexible drive coupling as previously explained, and in addition, the vibrator 28' is also mounted with elastomers 52 in order to additionally isolate vibrations from being imparted to mast 12 and to the housing of drive 16.

Figure 4:
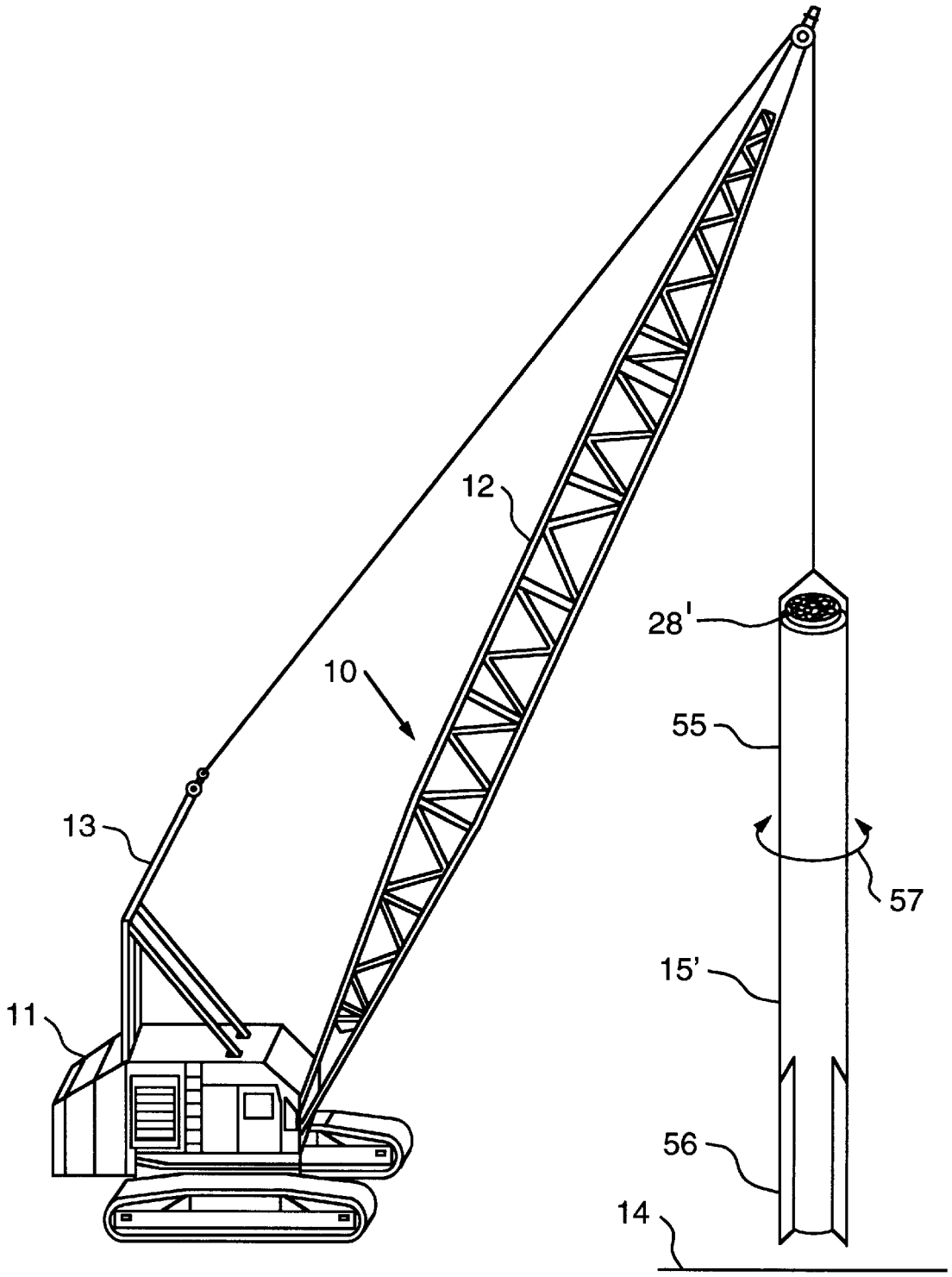
FIG. 4 is a general overall view in side elevation illustrating an apparatus utilizing the vibrator of the present invention for compacting soil.

Referring next to FIG. 4, the apparatus shown illustrates another application for the vibrator 28' of the present invention. In this illustration, identical or similar parts are designated with the same reference numerals utilized in the representation of the apparatus shown in FIGS. 1–3.

Here, the vibrator 28' is mounted on the top of caisson or pipe 55 in a horizontal plane instead of a vertical plane as illustrated in FIGS. 2 and 3. In other words, the center axis 46 of shaft 50 is oriented in a vertical position rather than a horizontal position and is coaxially aligned with the center of caisson or pipe 55.

Pipe 55 is provided with radially extending fins 56 at the bottom thereof.

Thus, when the caisson or pipe 55 is lowered into underlying earth, vibrations are applied thereto by the vibrator 28' which causes the entire probe made up of caisson or pipe 55 and fins 56 to vibrate with oscillatory motions about its center vertical axis as illustrated by arrow 57. This permits the caisson or pipe 55 to drive itself downwardly under its own weight into the underlying earth 14. In addition, once the caisson has been imbedded, the fins 56 are used for compacting sand or soil due to the oscillatory action of the vibrator 28'.

Accordingly the vibrator 28' in this manner may be utilized not only for driving caisson or pipe into the ground, but may also be utilized for compacting sand or soil with a vibrating probe.

In cases where the intention is purely to drive the caisson or pipe into the ground, the fins 56 are omitted.

I claim:

1. A vibrator for vibrating an object, said vibrator comprising; a rotary housing mounted on a frame for rotation about an axis, at least two rotary eccentric masses mounted at equally spaced intervals in said housing about said housing axis and mounted for rotation on respective axes which are parallel to said housing axis, a rotary drive connected for simultaneously rotating said eccentric masses in the same direction and in synchronism such that all masses are directed simultaneously to their innermost and their outermost positions of movement relative to said housing axis whereby a force moment is generated about said housing axis which rotatably oscillates said housing.

2. The vibrator of claim 1, including ballast mass attached to said vibrator for minimizing vibratory amplitude of the vibrator and thereby increasing vibratory forces applied to the object.

3. The vibrator of claim 1, including a circular gear coupled to and rotatably driven by said housing for alternating rotation therewith, said gear meshed with a gear rack for attachment to an object for imparting vibrations to the object through said gear and along a line.

4. The vibrator of claim 3, wherein a second drive is connected to said vibrator circular gear for driving said object into and out of underlying earth with said gear.

5. The vibrator of claim 4, including a flexible drive coupling between said drive and said circular gear for isolating said drive from vibrations generated by said vibrator.

6. The vibrator of claim 3, including a drive motor and a drive member driven by said motor and engaging said object for driving said object, and a flexible drive coupling disposed between said motor and said drive member for isolating said motor from vibrations generated by said vibrator.

7. The vibrator of claim 1, wherein said vibrator is mounted to a support with elastomer mounts for isolating said support from vibrations generated by said vibrator.

8. An apparatus for inserting flexible members downwardly into underlying earth, said apparatus including:

an articulatable mast to be arranged above underlying earth;

an elongated earth penetrating mandrel carried by said mast for guided movement therealong and for receiving a flexible member for movement with said mandrel to insert flexible members in underlying earth;

a mandrel drive mounted on said mast and engaged with said mandrel for driving said mandrel into and out of underlying earth;

a vibrator mounted for imparting vibrations to said mandrel to assist movement of said mandrel in underlying earth when said vibrator is energized;

the improvement comprising said vibrator having a rotary housing for rotation about an axis perpendicular to said mast, at least two rotary eccentric masses mounted at equally spaced intervals in said housing about said housing axis and mounted for rotation on respective axes which are parallel to said housing axis, a rotary drive connected for simultaneously rotating said eccentric masses in the same direction and in synchronism such that all masses are directed simultaneously to their innermost and their outermost positions of movement relative to said housing axis whereby a force moment is generated about said housing axis which rotatably oscillates said housing, a circular gear coupled to and rotatably driven by said housing for alternating rotation therewith, said gear meshed with a gear rack on said mandrel for imparting vibrations to said mandrel through said gear.

9. The apparatus of claim 8, including a ballast mass attached to said vibrator for minimizing vibratory amplitude of said vibrator and thereby increasing vibratory forces applied to said mandrel.

10. The apparatus of claim 8, wherein said drive is connected to said vibrator circular gear for driving said mandrel into and out of underlying earth with said gear.

11. The apparatus of claim 10, including a flexible drive coupling between said drive and said circular gear for isolating said drive from vibrations generated by said vibrator.

12. The apparatus of claim 8, said drive including a drive motor and a drive member driven by said motor and engaging said mandrel for driving said mandrel, and a flexible drive coupling disposed between said motor and said drive member for isolating said motor from vibrations generated by said vibrator.

13. The apparatus of claim 8, wherein said vibrator is mounted to said mast with elastomer mounts for isolating said mast from vibrations generated by said vibrator.

14. The apparatus of claim 13, wherein said vibrator is mounted to a bottom portion of said mast.

* * * * *